US007409833B2

(12) United States Patent
Unger et al.

(10) Patent No.: US 7,409,833 B2
(45) Date of Patent: Aug. 12, 2008

(54) DUAL MODE COMPRESSOR WITH AUTOMATIC COMPRESSION RATIO ADJUSTMENT FOR ADAPTING TO MULTIPLE OPERATING CONDITIONS

(75) Inventors: Reuven Z. M. Unger, Athens, OH (US); Joshua E. Collins, Athens, OH (US)

(73) Assignee: Sunpower, Inc., Athens, OH (US)

( * ) Notice: Subject to any disclaimer, the term of this patent is extended or adjusted under 35 U.S.C. 154(b) by 611 days.

(21) Appl. No.: 11/077,518

(22) Filed: Mar. 10, 2005

(65) Prior Publication Data

US 2006/0201171 A1 Sep. 14, 2006

(51) Int. Cl.
*F25B 41/00* (2006.01)
*F25B 49/00* (2006.01)

(52) U.S. Cl. ..... 62/196.2; 62/196.1; 62/196.3; 62/200; 62/204; 62/210; 62/228.1; 62/510; 417/254

(58) Field of Classification Search ..... 62/196, 62/196.2, 200, 204, 210, 228.5, 196.3, 228.1, 62/228.2, 228.3, 217, 510; 417/62, 222, 417/222.2, 270, 310, 490, 496, 500
See application file for complete search history.

(56) References Cited

U.S. PATENT DOCUMENTS

| | | | | |
|---|---|---|---|---|
| 793,864 | A | | 7/1905 | Voorhees |
| 877,492 | A | | 1/1908 | Doelling |
| 963,788 | A | | 7/1910 | Merrill |
| 1,036,934 | A | | 8/1912 | Toaz |
| 1,234,684 | A | | 7/1917 | Niebling |
| 1,307,061 | A | | 6/1919 | Olsen |
| 1,321,923 | A | | 11/1919 | Knox |
| 1,481,358 | A | | 1/1924 | Dwyer |
| 1,614,851 | A | | 1/1927 | Prestage |
| 2,006,584 | A | | 7/1935 | De Puy |
| 2,172,751 | A | | 9/1939 | Heinrich |
| 2,236,853 | A | | 4/1941 | Herzmark |
| 2,334,939 | A | | 1/1943 | Larson |
| 2,434,221 | A | * | 1/1948 | Newton ..... 62/175 |
| 2,973,133 | A | * | 2/1961 | Newton ..... 417/286 |
| 3,062,020 | A | * | 11/1962 | Heidorn ..... 62/196.1 |
| 3,303,664 | A | * | 2/1967 | Hansen ..... 62/217 |
| 3,745,855 | A | * | 7/1973 | Fawkes ..... 74/625 |
| 3,759,057 | A | | 9/1973 | English et al. |
| 3,848,422 | A | * | 11/1974 | Schibbye ..... 62/84 |
| 3,885,938 | A | * | 5/1975 | Ordonez ..... 62/196.2 |
| 4,297,083 | A | | 10/1981 | von Petery |
| 4,389,849 | A | | 6/1983 | Gasser et al. |
| 4,432,705 | A | | 2/1984 | Fraser et al. |
| 4,594,858 | A | * | 6/1986 | Shaw ..... 62/175 |
| 4,689,969 | A | * | 9/1987 | Van Steenburgh, Jr. ..... 62/474 |

(Continued)

*Primary Examiner*—Cheryl J. Tyler
*Assistant Examiner*—Joseph Corrigan
(74) *Attorney, Agent, or Firm*—Frank H. Foster; Kremblas, Foster, Phillips & Pollick

(57) ABSTRACT

An apparatus and method for compressing gas refrigerant using two different compressors operated alternatively in a series or parallel mode for obtaining two different compression ratios and thereby provide efficient operation for both a relatively lower suction pressure and a relatively higher suction pressure. This system avoids an unbalanced mass flow rate when the compressors are operated in series by unloading a downstream one of the compressors. When operated in the series mode, refrigerant is bypassed back to a suction inlet of the downstream compressor during a portion of a compression stroke of the downstream compressor for equalizing the mass flow rate through the two compressors.

17 Claims, 3 Drawing Sheets

U.S. PATENT DOCUMENTS 4,706,470 A * 11/1987 Akazawa et al. ..... 62/209
4,787,211 A * 11/1988 Shaw ..... 62/117
4,915,601 A * 4/1990 von Schuckmann ..... 417/472
4,947,655 A * 8/1990 Shaw ..... 62/200
5,095,712 A * 3/1992 Narreau ..... 62/113
5,191,776 A * 3/1993 Severance et al. ..... 62/513
5,537,820 A 7/1996 Beale et al.
5,577,390 A * 11/1996 Kaido et al. ..... 62/228.5
5,605,287 A * 2/1997 Mains ..... 239/402
5,768,901 A * 6/1998 Dormer et al. ..... 62/175
5,950,431 A * 9/1999 Oogushi ..... 60/468
6,085,533 A * 7/2000 Kaido et al. ..... 62/196.2
6,170,277 B1 * 1/2001 Porter et al. ..... 62/228.3
6,318,977 B1 11/2001 Kopko
6,321,550 B1 * 11/2001 Chopko et al. ..... 62/228.3
6,332,757 B1 * 12/2001 Kaneko et al. ..... 417/222.2
6,619,062 B1 * 9/2003 Shibamoto et al. ..... 62/228.3
6,820,434 B1 * 11/2004 Gutheim et al. ..... 62/175
2003/0084674 A1 * 5/2003 Kawaguchi et al. ..... 62/228.5
2004/0184932 A1 * 9/2004 Lifson ..... 417/310

* cited by examiner

DUAL MODE COMPRESSOR WITH AUTOMATIC COMPRESSION RATIO ADJUSTMENT FOR ADAPTING TO MULTIPLE OPERATING CONDITIONS

BACKGROUND OF THE INVENTION

1. Field of the Invention

This invention relates generally to compressors and more particularly to a compressor that can be easily adapted for use in any one of multiple systems so that identical compressor modules can be manufactured but can be installed in different applications having different operating conditions. The compressor can also be used in an application which has multiple operating conditions, such as a refrigeration system having multiple compartments maintained at multiple different temperatures, and can automatically change its operating mode in response to changes in operating conditions.

2. Description of the Related Art

Refrigeration and air conditioning systems have long used the phase change refrigeration cycle for cooling objects, such as food, to reduced temperatures and for maintaining them at a reduced temperature for preservation. These refrigeration systems have a closed loop in which a refrigerant is compressed to a compressor discharge pressure and discharged into a heat exchanging condenser where heat is rejected. Refrigerant is accumulated in the condenser and metered from the condenser into an evaporator where heat is accepted through the evaporator walls from the stored objects in thermal connection with the evaporator. The rate at which the refrigerant is metered into the evaporator is controlled by a temperature control system which senses the temperature of the objects and meters the refrigerant into the evaporator as a function of evaporator temperature. From the evaporator the refrigerant is returned at a suction pressure to a compressor to complete the closed loop.

The design temperature that is sought to be maintained by a refrigeration system is dependent upon the particular application. Because there are an extensive variety of applications for refrigeration systems, their design temperatures vary over a wide range. For example, a refrigerator may be designed to preserve food in a state that does not damage some foods or require thawing of the foods. This refrigerator has a fresh food compartment in which food is retained in a relatively higher temperature zone at slightly above 0° C. Another refrigeration system may be designed to freeze food and therefore has a freezer compartment in which food is retained in a significantly lower temperature zone, for example in the range of −17° C. to −40° C. In the higher temperature zone of the fresh food compartment, the refrigerant is exposed to a higher temperature than in the lower temperature freezer zone. Consequently, the refrigerant in the evaporator of the fresh food compartment has a higher temperature, pressure and density and therefore presents a higher suction pressure to the compressor. The refrigerant in the evaporator of the freezer compartment is exposed to a lower temperature and therefore has a lower temperature, pressure and density and therefore presents the compressor with a lower suction pressure.

Alternatively, a single refrigeration system can be provided with multiple cooling compartments for maintaining objects at a different temperature in each compartment. A refrigerator may have both a fresh food compartment and a freezer compartment in which food is retained at the above temperatures. In the higher temperature zone of the fresh food compartment, the refrigerant is exposed to a higher temperature than in the lower temperature freezer zone. Consequently, the refrigerant in the evaporator of the fresh food compartment has a higher temperature, pressure and density and therefore presents a higher suction pressure to the compressor. The refrigerant in the evaporator of the freezer compartment is exposed to a lower temperature and therefore has a lower temperature, pressure and density and therefore presents the compressor with a lower suction pressure. Although it is common to provide home refrigerators with only a single evaporator and it is also known to connect two evaporators in series, a compressor can supply refrigerant to multiple evaporators for multiple compartments, with each compartment having its own temperature control system and expansion valve for metering refrigerant flow through the expansion valve for its compartment.

Although compressors are used in refrigeration systems, they are also used in a variety of other applications. Compressor applications expose compressors to different suction pressures and other intake gas parameters, either because compressors of one design may be installed in different applications each having a different operating condition or because a single compressor may be exposed to multiple operating conditions in a single application. The existence of these different operating conditions means that the compressor may alternatively be exposed to: (1) a relatively higher gas temperature, density and suction pressure and (2) a relatively lower gas temperature, density and suction pressure. For a compressor that has a piston reciprocating in a cylinder, the volume flow rate is proportional to the piston stroke and is simply the displacement. However, the mass flow rate is not only a function of the displacement, but also is a function of the gas density. This is the result of the fact that the same volume of a gas has less mass if the gas is at a lower density and more mass if at a higher density. Therefore, when a refrigeration compressor is presented with different operating conditions that provide a gas at different densities and suction pressures, the mass flow rate through the compressor changes in response to changes in density, temperature and suction pressure of the gas refrigerant.

If a compressor is optimized for any one of these multiple operating conditions, it will not be optimized for the other. If it is optimized for an intermediate condition, it will not be optimized for any. For example, if the compressor is designed to operate at a relatively lower suction pressure and density and to provide a selected mass flow rate under that operating condition, if it is operated at a relatively higher suction pressure and density condition, the mass flow rate through the compressor will increase approximately in proportion to the change in the density.

Under the condition of a higher temperature, density and suction pressure, such as for supplying refrigerant to cool a fresh food compartment, the compressor should have a lower compression ratio in order to deliver compressed refrigerant gas at the desired discharge pressure into the condenser. At the condition of a lower temperature, density and suction pressure, such as for supplying refrigerant for cooling a freezer compartment, a higher compression ratio is needed to deliver the gas to the condenser at the desired discharge pressure.

It is an object and feature of the invention to provide a compressor that can adapt to these different operating conditions by changing its mode of operation in order to optimize its efficiency and provide the desired compression ratio for both operating conditions.

BRIEF SUMMARY OF THE INVENTION

The invention is a dual-mode compressor apparatus using two compressors operated alternatively in series or parallel mode for compressing refrigerant or other gas at either of two compression ratios. The dual mode operation accommodates either of two operating conditions but does so in a manner that avoids an unbalanced mass flow rate through the compressors when they are operated in a series mode. The compressors are operated in parallel when the input suction pressure is above a selected pressure. When the input suction pressure is below a selected pressure, the compressors are operated in series and the downstream one of the compressors is unloaded by passing refrigerant back to a suction inlet of the downstream compressor during a portion of a compression stroke of the downstream compressor for equalizing mass flow through the two compressors.

The upstream, first compressor has a suction port connected to receive gas from a gas supplying enclosure. The downstream, second compressor has a discharge port connected to an inlet of a gas receiving enclosure. A 3/2 way valve has its inlet connected to the discharge port of the upstream, first compressor, a first outlet connected to the inlet of the gas receiving enclosure and a second outlet connected to the suction port of the downstream, second compressor. A one way valve is connected between the gas supplying enclosure and the suction port of the downstream, second compressor for permitting passage of the gas from the gas supplying enclosure into the suction port of the downstream, second compressor except when pressure at the suction port of the downstream, second compressor exceeds the pressure of the gas supplying enclosure. An unloading valve has an inlet connected in communication with an unloading port through the cylinder of the downstream, second compressor between the reciprocation limits of its piston. The unloading valve also has an outlet connected to the suction port of the downstream, second compressor. The unloading valve is closed except when pressure at the suction port of the downstream, second compressor exceeds the pressure at the suction port suction port of the upstream, first compressor. When the unloading valve is opened, the compression ratio of the downstream, second compressor is reduced in order to equalize gas mass flow rate through the two compressors.

Figure 1:
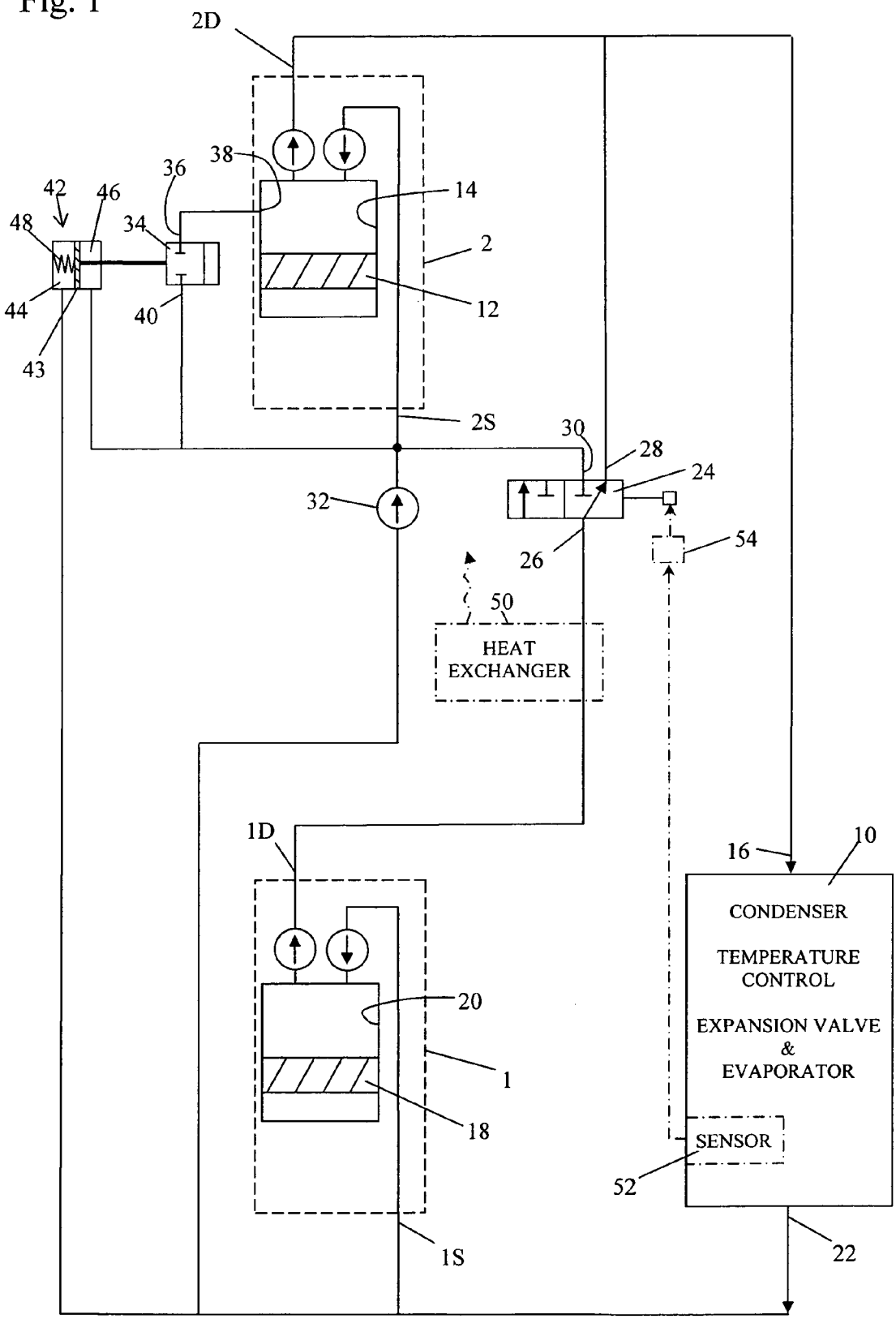
FIG. 1 is a schematic and diagrammatic view of an embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto is used. They are not limited to direct connection, but include connection through other elements where such connection is recognized as being equivalent by those skilled in the art.

DETAILED DESCRIPTION OF THE INVENTION

FIG. 1 illustrates the basic principles of the dual-mode compressor apparatus of the invention which is used for receiving and compressing a gas from a gas supplying enclosure and discharging compressed gas into a gas receiving enclosure. The invention is illustrated in a refrigeration application that includes a condenser, temperature control system, expansion valve and evaporator. Because the invention resides in the compressor apparatus, these other components are lumped together and illustrated as non-compressor apparatus 10. The components of the non-compressor apparatus 10 are constructed and arranged according to principles well known to those skilled in the art of refrigeration using a closed loop refrigeration system known as the phase change refrigeration cycle or the Rankine cycle. The systems use vapor compression in which the vapor is often treated for design purposes as a gas. The term gas is used herein to include vapor. In accordance with these principles, the gas is a refrigerant, the gas supplying enclosure is an evaporator of the refrigeration system from which refrigerant is drawn, compressed and discharged at a higher pressure into a condenser, which is the gas receiving enclosure.

The compressor apparatus is a dual compressor apparatus because it has two compressors. A first compressor 1 has a piston 18 reciprocating in a cylinder 20 between reciprocation limits and has a suction port that is the first suction port 1S of the dual compressor apparatus. The first suction port 1S is connected to receive gas from the outlet 22 of a gas supplying enclosure, which is the evaporator of the apparatus 10. The first compressor 1 also has a discharge port that is the first discharge port 1D of the dual compressor apparatus. The first compressor 1 has the conventional one way valves for intake and exhaust of gas into and out of the cylinder 20.

A second compressor 2 also has a piston 12 reciprocating in a cylinder 14 between reciprocation limits. The second compressor 2 has a second suction port 2S and a second discharge port 2D connected to a gas receiving enclosure, and in particular to an inlet 16 leading to the condenser of the apparatus 10. The second compressor 2 also has the conventional one way valves for intake and exhaust of gas into and out of the cylinder 14 in the known manner.

Preferably, the two compressors have the same displacement because, in one mode of operation, they operate in parallel connection. Most preferably the two compressors are identical and are operated simultaneously at the same stroke and frequency. These preferred configurations provide identical loading, compression parameters and life expectancy and also minimize cost because only one compressor design and one manufacturing operation is needed. It is also preferred that their pistons reciprocate coaxially and oppositely phased so that the inertia forces are cancelled in order to minimize vibration.

The invention uses a 3/2 way valve. A 3/2 way valve has three ports and two states. It connects an inlet alternatively to either one of two outlets and blocks the other outlet and is somewhat analogous to a single pole double throw electrical switch. They are sold commercially, are very common in heat-pumps and typically are fabricated as a slide or spool valve. In FIG. 1, a 3/2 way valve 24 has an inlet 26 connected to the first discharge port 1D, a first outlet 28 connected to the inlet 16 of the gas receiving enclosure and a second outlet 30 connected to the second suction port 2S of the second compressor 2. This 3/2 way valve 24 switches the connection of the first compressor 1 between two states. In the state illustrated in FIG. 1, the first compressor 1 is connected in parallel with the second compressor 2 so that both compressors intake gas at the suction pressure of the evaporator at outlet 22. When the state of the 3/2 way valve 24 is switched, the two compressors are operated in series because the first compressor 1 intakes gas at the suction pressure of the evaporator at outlet 22 and discharges compressed gas through the 3/2 way valve 24 into the second suction port 2S of the second compressor 2 where the gas can be further compressed. The 3/2 way valve 24 can be switched between the series and parallel states manually or by an actuator responding to a control signal. For example, it can be switched manually to the state that is best suited for a suction pressure operating condition in the particular application in which it is to be used A one way valve 32 is connected between the outlet 22 from the gas supplying enclosure (the evaporator) and the second suction port 2S for permitting passage of the gas from the gas supplying enclosure into the second suction port 2S except when pressure at the second suction port 2S exceeds pressure at the gas supplying enclosure outlet 22. This one way valve 32 operates to close when the two compressors are operated in series as a result of switching the state of the 3/2 way valve 24 from the parallel state illustrated in FIG. 1 to its series state. The one way valve 32 closes because compressed gas, which is compressed by the first compressor 1, flows from the first discharge port 1D through the 3/2 way valve 24 to the second suction port 2S. Therefore the pressure at the second suction port 2S is greater than the pressure at the first suction port 1S. However, when the compressors are operated in parallel mode, the higher pressure gas from the first compressor 1 passes instead to the condenser inlet 16 and therefore gas is drawn by the second compressor 2 in through its suction port 2S by the piston 12.

When the two compressors are operated in parallel, it is desirable that both operate with their maximum volume displacement so that the flow rate is maximized. However, when the two compressors are operated in series, the suction pressure at the downstream, second stage compressor 2, is greater than the suction pressure at the upstream, first stage compressor 1. Therefore, unless the compressors had very different volume displacements or frequencies of reciprocation, the mass flow rate through each of the two series-connected compressors would be different. This, however, is impossible because the gas is flowing in series through both. The change in mass flow rate would increase the work done by the second stage, downstream compressor so that the two, identical compressors in series would have unbalanced loading. Therefore, if the compressors are operated so that their pistons reciprocate along a common axis but 180° out of phase in order to minimize vibration, the unbalanced loading would cause the compressors to operate unbalanced and therefore reduce the cancellation of vibration forces. This is particularly true if the compressors are free piston compressors in which the stroke is a function of loading. Of course, with a free piston compressor, the stroke of one compressor could be reduced in order to reduce the mass flow rate of the second stage. However, not only is it difficult to adjust the mass flow rate of a compressor, but also if two free piston compressors are operated coaxially in order to reduce vibration and the stroke of one piston is reduced, that will itself create an imbalance of the inertial forces which will reduce the vibration cancellation and permit greater vibration.

In order to solve this problem and permit the downstream compressor to further compress gas already compressed by the upstream compressor, an unloading valve 34 is arranged to decrease the volume flow rate, i.e. the effective volume displacement, of the downstream compressor 2 in order to equalize or match the mass flow rate through the two compressors when they are operated in the series mode. This is done in a way that maintains the same piston stroke, while decreasing the volume displaced. The unloading valve 34 has an inlet 36 connected in communication with an unloading port 38 through the cylinder 14 of the second compressor 2. The port 38 is positioned between the limits of reciprocation of the piston 12. The exact position of the port 38 for any particular embodiment is selected by the designer to provide the desired compression ratio for matching the mass flow rate through the two compressors when operated in the series mode. The unloading valve 34 has an outlet 40 connected to the second suction port 2S. The unloading port 38 is maintained closed by the unloading valve 34 except when the pressure at the second suction port 2S exceeds the pressure at the first suction port 1S. With the unloading valve 34 in its closed state, the second compressor 2 operates in a normal manner with the two compressors connected in parallel. However, when the pressure at the downstream, second suction port 2S becomes greater than the pressure at the upstream, first suction port 1S, the unloading valve 34 is opened to reduce the compression ratio of the first compressor 1 in order to equalize gas mass flow rate through the two compressors.

Opening the unloading valve 34 reduces the effective compression ratio of the downstream, second compressor 2 because the interior of the cylinder 14 remains in communication with the second suction port 2S except when the piston 12 covers the unloading port 38. While the unloading port 38 is opened, any gas drawn into the cylinder 14 is simply forced back to the suction port 2S until the piston 12 covers the unloading port 38 while traveling in a compression stroke. As the piston 12 thereafter continues toward its top-dead-center position (one limit of its travel), the gas remaining in the cylinder 14 is compressed. Consequently, the volume displacement of the second compressor 2, while operating in the series mode, is determined by the location of the unloading port 38 between the limits of the travel of the piston 12. Specifically, that volume displacement is the distance from the unloading port 38 to the limit of piston reciprocation multiplied by the area of the cylinder 14.

Operation of the unloading valve 34 is made automatic by linking the unloading valve 34 to a differential pressure actuator 42. Since the unloading valve 34 is switched in response to the pressure relationship between the second suction port 2S and the first suction port 1S, the differential actuator 42 has two chambers separated by a piston or preferably a flexible diaphragm 43 which can be better sealed to a cylinder wall at its periphery. One chamber 44 is connected in fluid communication with the first suction port 1S and the other chamber 46 is connected in fluid communication with the second suction port 2S. The differential actuator 46 is biased by a spring 48 to close the unloading valve except when the pressure at the second suction port 2S exceeds the pressure at the first suction port 1S and pushes the diaphragm 43 to switch the unloading valve 34 to its open state. A typical activation threshold pressure differential for actuating the differential pressure actuator 42 to open the unloading valve 34 is on the order of 1 bar for typically anticipated applications.

Although the use of a differential pressure actuator is preferred, other actuators can be used. For example, an electromagnetic actuator or solenoid can be used. Its actuating signal can be derived from a differential pressure sensor or it can be generated by a control system.

When the dual compressors are operated in the series mode, the gas compressed by the first compressor 1 will be heated in accordance with thermodynamic principles. Although this heat can be rejected in the condenser in the ordinary manner, efficiency can be improved if a heat exchanger 50 is interposed in connection between the first discharge port 1D and the second suction port 2S . Preferably, the heat exchanger 50 is connected between the first discharge port 1D and the inlet 26 of the 3/2 way valve. The heat exchanger 50 rejects heat from refrigerant compressed by the first compressor 1 before the refrigerant is compressed by second compressor 2. This is done to enhance the efficiency of the downstream second compressor 2 by introducing heat rejection between the stages so that the second stage "starts" its compression with a colder gas. The heat exchanger 50 can be a structure similar to a condenser.

Although switching the state of the 3/2 way valve 24 is principally contemplated to be done manually, it can be done by an automatic control system in a variety of ways. For example, a pressure or temperature sensor 52 can alternatively be mounted to detect the pressure or temperature of the gas at the first suction port 1S which is connected to the outlet 22 of the apparatus 10. The sensor 52 is connected to a control and actuator 54, which may for example include a solenoid, for switching the 3/2 way valve. The control and actuator 54 switches the 3/2 way valve to a state connecting its inlet 26 to the condenser inlet 16 in response to a sensed pressure or temperature above a selected value and to connect its inlet 26 to the second suction port 2S in response to a sensed pressure or temperature below a selected value. In this way, when the sensor senses a lower pressure operating condition that makes operation in the series mode more efficient, the dual compressor system will be switched to its series mode. Similarly, when a higher pressure is sensed, the dual compressor system will be switched to its parallel mode.

Figure 2:
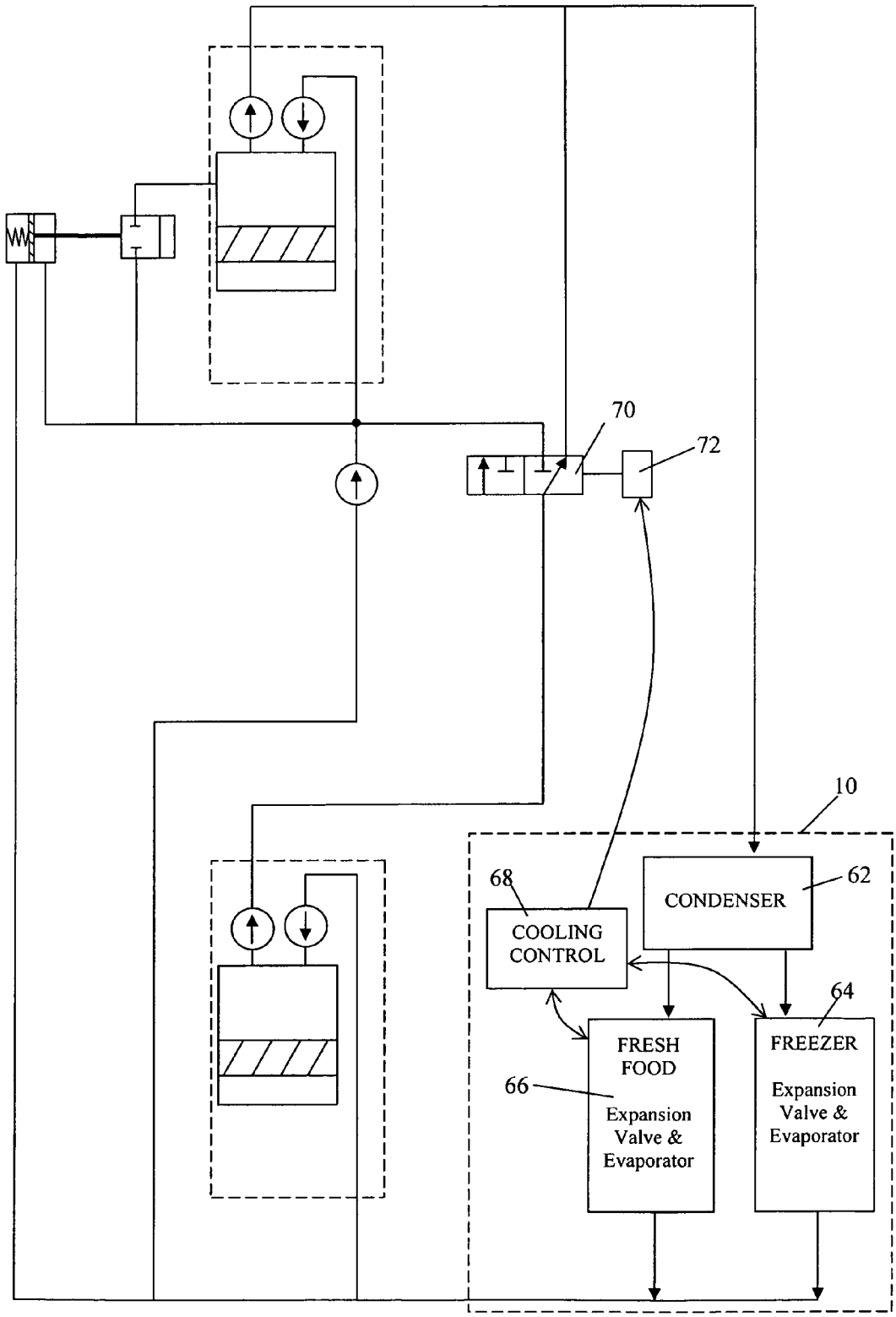
FIG. 2 is a schematic and diagrammatic view of another embodiment of the invention.

FIG. 2 illustrates an alternative embodiment to which the alternatives described in connection with FIG. 1 are also applicable. The dual mode compressor illustrated in FIG. 2 is the same as that illustrated in FIG. 1 except as described otherwise. Although embodiments of the invention are principally contemplated for use in applications having different operating conditions with the embodiments being manually placed in either the parallel or series mode in response to the operating conditions of the applications, an embodiment of the invention can also be used in an application in which the operating conditions change during the course of ordinary use. In such an application, the system is provided with a control system that senses an operating condition parameter and then switches modes in accordance with the sensed operating condition.

FIG. 2 illustrates an example of one such application. A non-compressor apparatus 60 has a condenser 62 that supplies refrigerant independently to each of two evaporators. For example, one evaporator/expansion valve 64 cools a fresh food compartment and the other evaporator/expansion valve 66 cools a freezer compartment and these two compartments are at different temperatures. These have the well known expansion valves, cooling control valves for controlling the flow of refrigerant through the expansion valves and a temperature control system 68. As known in the art, the expansion valve and the cooling control valve can be integrated to get the same function of controlling the flow of refrigerant through the expansion valve. In the conventional manner, the temperature control system 68 senses the temperature in each evaporator and supplies refrigerant to the evaporator needing cooling. Therefore, the electrical signal or other condition that is used to control the expansion valves can also supply a signal to switch the state of the 3/2 way valve. The freezer evaporator and the fresh food evaporator operate at two significantly different temperatures and therefore exhibit substantially different suction pressures. When the control signal of the temperature control system 68 senses a sufficiently high temperature in the freezer compartment and actuates the expansion valve for the freezer compartment evaporator, that actuation signal can also be used to place the 3/2 way valve 70 in its state for the series mode of operation. Similarly, when it senses a sufficiently high temperature in the fresh food compartment and actuates the expansion valve to provide cooling to the fresh food evaporator, the signal is used to switch the 3/2 way valve 70 to its parallel state. These signals can be processed or modified by an intermediate control if needed and are applied to an actuator 72 in order to select the state of the 3/2 way valve 70.

As an alternative, the cooling control valves, that control and alternately direct the flow of refrigerant to the respective freezer evaporator/expansion valve 64 and the fresh food evaporator/expansion valve 66, can be added to the valve 70. In that way a single slide or spool valve can control both the switching of the compressor mode between series and parallel and also the direction of refrigerant into the evaporator of either the fresh food compartment or the freezer compartment as determined by the cooling control 68. As another alternative, the mode control valve and the refrigerant control valves can be individual valves but all controlled by the actuator 72. This illustrates that the invention is not limited to a valve that is only a 3/2 way valve. A valve can be used that has other inlets and outlets on the same physical valve structure. All that is needed is that at least a part of the valve be operable as a valve with an inlet and two outlets with the valve have two states, each state connecting the inlet to one of the outlets and blocking the other outlet.

Figure 3:
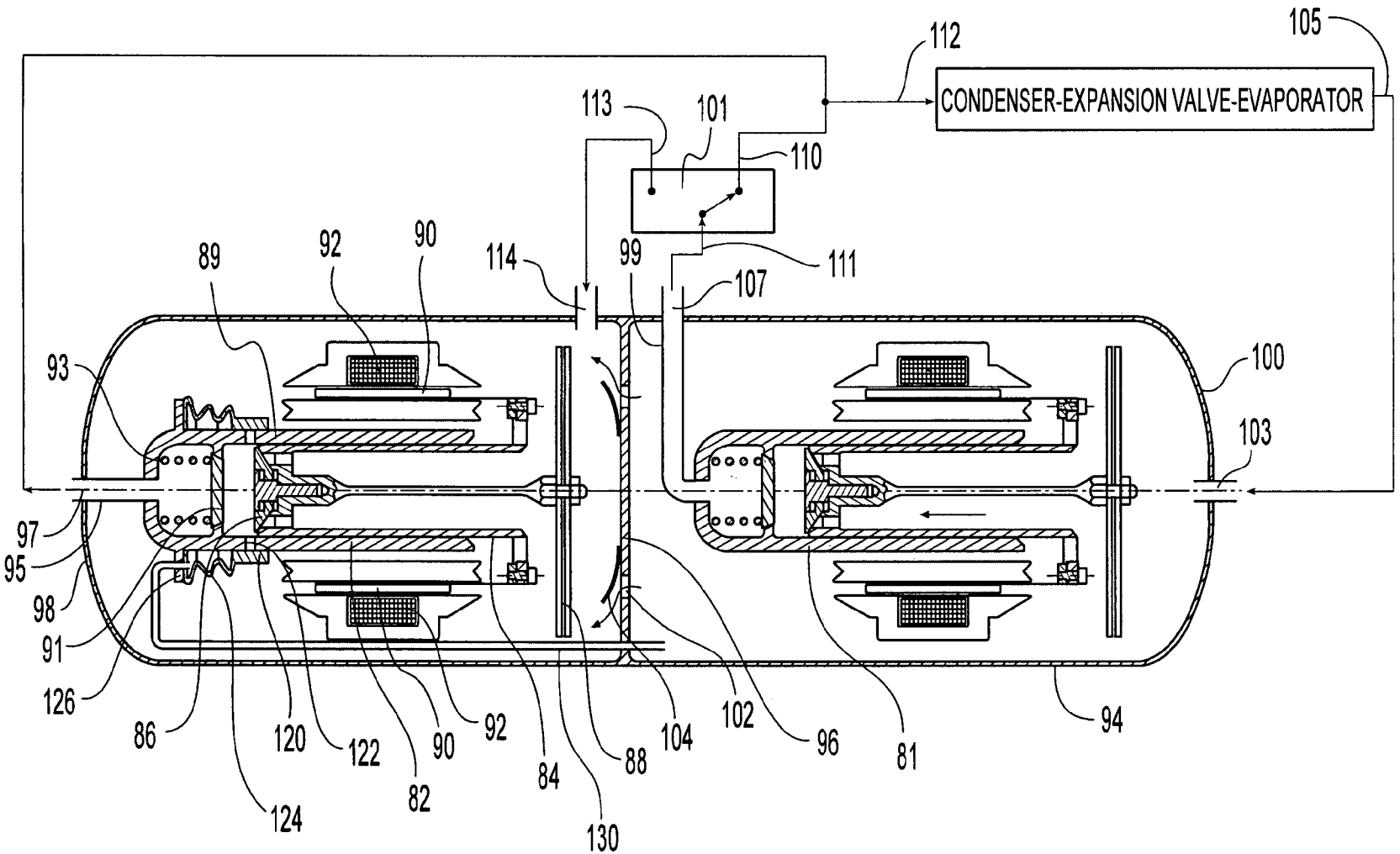
FIG. 3 is a view in section of the preferred embodiment of the invention.

FIG. 3 illustrates the preferred embodiment of the invention. Each compressor comprises a free piston compressor having its piston driven by a linear motor. Such compressors are well known in the art. One compressor 82 has a piston 84 which carries an intake check valve 86 at its end face. The piston 84 is connected by a connecting rod to a planar spring 88 so that it can reciprocate, preferably at a resonant frequency within a cylinder 89. The piston 84 is driven in reciprocation by its attachment to an annular array of magnets 90 which are driven in reciprocation by an alternating magnetic field generated by an alternating current flowing though armature windings 92. The cylinder 89 is connected through a one way valve 91 that is biased by a spring 93 and permits exhaust of compressed gas through a conduit 95 to a discharge port 97.

The other compressor 81 is nearly identical to the compressor 82 describe above. It discharges compressed gas through a conduit 99 and a discharge port 107 to a 3/2 way valve 101 which corresponds to the 3/2 way valve 24 of FIG. 1. It also has a first suction port 103 connected to the outlet 105 from an evaporator and opening into its housing. The compressor 81 is preferably mounted coaxially with the compressor 82 so that their respective pistons can reciprocate in opposite directions along same axis and 180° out of phase and thereby minimize vibration.

Each of the two compressors is enclosed in a housing that is sealed except for defined passages so that each housing will confine the gas refrigerant under pressure. The housings are formed by a generally cylindrical wall 94 that is separated into the two housings by an intermediate wall 96 and sealed at its ends by end caps 98 and 100. The interior volume of each piston is in open gas communication with the interior of its housing so that the interior of each housing is at the suction pressure of the compressor that it houses.

Passages 102 extend through the intermediate wall 96 and therefore between the two compressor housings. A one way valve, illustrated in the form of a flapper valve 104 mounted at the passage 102, connects the interior of the housings in a manner corresponding to the one way valve 32 in FIG. 1. Preferably there are a plurality of circularly arranged such flapper valves. The one way flapper valves 104 have minimum bias so that, like the valve 32, only a relatively small pressure differential across them is needed to open the flapper valves 104.

As in the embodiment of FIG. 1, the 3/2 way valve 101 has a first outlet 110 connected to the condenser inlet 112 and a second outlet 113 connected to a suction port 114 of the compressor 82. The inlet 111 of the 3/2 way valve 101 is connected to the discharge port 107. The discharge port 97 of the compressor 82 is connected to the condenser inlet 112. The 3/2 way valve 101 therefore alternatively connects the first stage compressor 81 in series with the second stage, downstream compressor 82 or in parallel with the compressor 82.

FIG. 3 also illustrates an example of an unloading valve and its differential actuator. This unloading valve and differential actuator is formed by an annular sleeve 120 sealingly surrounding the cylinder 89 of the second compressor 82. The sleeve 120 is axially slidable along the exterior surface of the cylinder 89 so that the sleeve can alternatively cover and uncover the unloading ports 122 which are circumferentially spaced around the cylinder 89. In order to minimize leakage, the inner surface of the sleeve 120 and the interfacing outer surface of the cylinder 89 have a tight clearance similar to the clearance that is typical of the clearance between the piston and cylinder.

An annular bellows 124 is sealingly attached at one end to the annular sleeve 120 and sealingly attached at its opposite end to the cylinder 89 through an intermediate annular flange 126 extending from the cylinder 89. This forms a sealed interior chamber within the bellows 124. The exterior surface of the bellows is in fluid communication with the suction pressure of the second compressor 82 because, as described above, the entire interior of the housing for the compressor is at their respective suction pressures. The bellows 124 and sleeve 120, when attached together, are mounted so that the sleeve 120 covers the unloading port 122 when the pressure differential between the interior chamber of the bellows and the exterior surface of the bellows is zero or less than a selected pressure differential.

A conduit 130 connects the interior chamber of the bellows 124 in fluid communication with the interior of the housing for the first compressor 81 and therefore in communication with the first suction port 103 which is at the suction pressure of the first compressor 81. Therefore, the pressure differential between the opposite sides of the bellows is the pressure differential between the suction pressure of the second compressor and the suction pressure of the first compressor. This permits the bellows to be collapsed and move the sleeve away from the unloading port to open the unloading port into gas communication with the suction volume when the pressure on the exterior surface of the bellows exceeds the pressure in the interior chamber of the bellows.

In operation, the invention uses multiple compressors to compress refrigerant and automatically adjust to different input suction pressures by operating at a selected one of two compression ratios and thereby avoids an unbalanced mass flow rate. More specifically, the dual mode compressor of the invention compresses the refrigerant in two different compressors and in a selected one of two alternative modes. Those modes are: (i) operating the compressors in parallel when the input suction pressure is above a selected pressure; and (ii) operating the compressors in series when input the suction pressure is below a selected pressure and unloading a downstream one of the compressors by passing refrigerant back to a suction inlet of the downstream compressor during a portion of the compression stroke of the downstream compressor for equalizing mass flow through the two compressors.

This is accomplished by detecting a pressure differential between the input, first suction pressure and the suction pressure of the downstream compressor and connecting a port in a cylinder wall of the downstream compressor in fluid communication with a suction port of the downstream compressor when the suction pressure of the downstream compressor exceeds the input suction pressure of the upstream compressor.

While certain preferred embodiments of the present invention have been disclosed in detail, it is to be understood that various modifications may be adopted without departing from the spirit of the invention or scope of the following claims.

The invention claimed is:

1. A dual-mode compressor apparatus for receiving and compressing a gas from a gas supplying enclosure and discharging compressed gas into a gas receiving enclosure, the apparatus comprising:

(a) a first compressor having a piston reciprocating in a cylinder between limits, the first compressor having a first suction port connected to receive gas from the gas supplying enclosure and having a first discharge port;

(b) a second compressor having a piston reciprocating in a cylinder between reciprocation limits, the second compressor having a second suction port and having a second discharge port connected to an inlet of the gas receiving enclosure;

(c) a 3/2 way valve having an inlet connected to the first discharge port, a first outlet connected to an inlet of the gas receiving enclosure and a second outlet connected to the second suction port;

(d) a one way valve connected between the gas supplying enclosure and the second suction port for permitting passage of the gas from the gas supplying enclosure into the second suction port except when pressure at the second suction port exceeds pressure at the gas supplying enclosure;

(e) an unloading valve having an inlet connected in communication with an unloading port through the cylinder of the second compressor between the reciprocation limits and having an outlet connected to the second suction port, the unloading valve being adapted to be closed except when pressure at the second suction port exceeds the pressure at the first suction port, the unloading valve, when opened, reducing the volume displacement of the second compressor in order to equalize gas mass flow rate through the two compressors; and (f) a first refrigeration evaporator that is said gas supplying enclosure;

a second evaporator, the evaporators operating at different temperatures, a cooling control valve for controlling the flow of refrigerant into each evaporator and a temperature control for controlling the control valves and directing refrigerant into the evaporators, the temperature control being connected to an actuator that actuates the 3/2 way valve for switching the 3/2 way valve between its two states wherein the unloading valve is linked to a differential pressure actuator having two chambers, one chamber being connected in fluid communication with the first suction port and the other chamber being connected in fluid communication with the second suction port, the differential actuator being biased to close the unloading valve except when pressure at the second suction port exceeds the pressure at the first suction port; and wherein the gas is a refrigerant, and the gas receiving enclosure is a refrigeration condenser.

2. An apparatus in accordance with claim 1 wherein a heat exchanger is interposed in connection between the first discharge port and the second suction port for rejecting heat from refrigerant compressed by the first compressor before being compressed by second compressor.

3. An apparatus in accordance with claim 1 wherein each compressor comprises a free piston compressor having its piston driven by a linear motor and enclosed in a housing, the suction port of each compressor being in communication with the interior of its housing, the compressors being mounted coaxially and having a passage between their housings, the one way valve being mounted at said passage.

4. An apparatus in accordance with claim 3 wherein the unloading valve is linked to a differential pressure actuator having two chambers, one chamber being connected in fluid communication with the first suction port and the other chamber being connected in fluid communication with the second suction port, the differential actuator being biased to close the unloading valve except when pressure at the second suction port exceeds the pressure at the first suction port.

5. An apparatus in accordance with claim 4 wherein the gas is a refrigerant, the gas supplying enclosure is a refrigeration evaporator and the gas receiving enclosure is a refrigeration condenser.

6. An apparatus in accordance with claim 5 wherein the 3/2 way valve is manually actuable.

7. An apparatus in accordance with claim 1 wherein a pressure or temperature sensor is mounted to detect pressure or temperature at the first suction port, the sensor being connected to a control and actuator for switching the 3/2 way valve, the control switching the 3/2 way valve to a state connecting its inlet to the condenser inlet in response to a sensed pressure or temperature above a selected value and to connect its inlet to the second suction port in response to a sensed pressure or temperature below a selected value.

8. An apparatus in accordance with claim 1 wherein the 3/2 way valve is manually actuable.

9. A dual-mode compressor apparatus for receiving and compressing a gas from a gas supplying enclosure and discharging compressed gas into a gas receiving enclosure, the apparatus comprising:

(a) a first compressor having a piston reciprocating in a cylinder between limits, the first compressor having a first suction port connected to receive gas from the gas supplying enclosure and having a first discharge port;

(b) a second compressor having a piston reciprocating in a cylinder between reciprocation limits, the second compressor having a second suction port and having a second discharge port connected to an inlet of the gas receiving enclosure;

(c) a 3/2 way valve having an inlet connected to the first discharge port, a first outlet connected to an inlet of the gas receiving enclosure and a second outlet connected to the second suction port;

d) a one way valve connected between the gas supplying enclosure and the second suction port for permitting passage of the gas from the gas supplying enclosure into the second suction port except when pressure at the second suction port exceeds pressure at the gas supplying enclosure; and (e) an unloading valve having an inlet connected in communication with an unloading port through the cylinder of the second compressor between the reciprocation limits and having an outlet connected to the second suction port, the unloading valve being adapted to be closed except when pressure at the second suction port exceeds the pressure at the first suction port, the unloading valve, when opened, reducing the volume displacement of the second compressor in order to equalize gas mass flow rate through the two compressors, wherein the unloading valve comprises;

(a) an annular sleeve sealingly surrounding the cylinder of the second compressor and slidable to alternatively cover and uncover the unloading port;

(b) an annular bellows sealingly attached at one end to the annular sleeve and sealingly attached at its opposite end to the cylinder of the second compressor to form an interior chamber, the bellows having an exterior surface in fluid communication with second suction port, the attached bellows and sleeve being mounted with the sleeve covering the unloading port when the pressure differential between the interior chamber and the exterior surface of the bellows is less than a selected pressure differential; and (c) a conduit connecting the interior chamber of the bellows in fluid communication with the first suction port for permitting the bellows to be collapsed and move the sleeve away from the unloading port when the pressure on the exterior surface of the bellows exceeds the pressure of the first suction port.

10. An apparatus in accordance with claim 9 wherein the gas is a refrigerant, the gas supplying enclosure is a refrigeration evaporator and the gas receiving enclosure is a refrigeration condenser.

11. An apparatus in accordance with claim 9 wherein a heat exchanger is interposed in connection between the first discharge port and the second suction port for rejecting heat from refrigerant compressed by the first compressor before being compressed by second compressor.

12. An apparatus in accordance with claim 9 wherein the 3/2 way valve is manually actuable.

13. An apparatus in accordance with claim 9 wherein a pressure or temperature sensor is mounted to detect pressure or temperature at the first suction port, the sensor being connected to a control and actuator for switching the 3/2 way valve, the control switching the 3/2 way valve to a state connecting its inlet to the condenser inlet in response to a sensed pressure or temperature above a selected value and to connect its inlet to the second suction port in response to a sensed pressure or temperature below a selected value.

14. An apparatus in accordance with claim 9 wherein each compressor comprises a free piston compressor having its piston driven by a linear motor and enclosed in a housing, the suction port of each compressor being in communication with the interior of its housing, the compressors being mounted coaxially and having a passage between their housings, the one way valve being mounted at said passage.

15. An apparatus in accordance with claim 14 wherein the unloading valve is linked to a differential pressure actuator having two chambers, one chamber being connected in fluid communication with the first suction port and the other chamber being connected in fluid communication with the second suction port, the differential actuator being biased to close the unloading valve except when pressure at the second suction port exceeds the pressure at the first suction port.

16. An apparatus in accordance with claim 15 wherein the gas is a refrigerant, the gas supplying enclosure is a refrigeration evaporator and the gas receiving enclosure is a refrigeration condenser.

17. An apparatus in accordance with claim 16 wherein the 3/2 way valve is manually actuable.

* * * * *